US008864596B1

(12) United States Patent
Maranian, Jr.

(10) Patent No.: US 8,864,596 B1
(45) Date of Patent: Oct. 21, 2014

(54) GOLF PUTTING BOX

(71) Applicant: Arthur A. Maranian, Jr., Woburn, MA (US)

(72) Inventor: Arthur A. Maranian, Jr., Woburn, MA (US)

( * ) Notice: Subject to any disclaimer, the term of this patent is extended or adjusted under 35 U.S.C. 154(b) by 54 days.

(21) Appl. No.: 13/815,695

(22) Filed: Mar. 14, 2013

(51) Int. Cl.
*A63B 69/36* (2006.01)

(52) U.S. Cl.
CPC ..... *A63B 69/3661* (2013.01)
USPC ..... 473/162

(58) Field of Classification Search
USPC ..... 473/157–167, 181
See application file for complete search history.

(56) References Cited

U.S. PATENT DOCUMENTS 1,676,975 A * 7/1928 Anderson et al. ..... 473/180
1,952,187 A * 3/1934 Ripley ..... 473/158
3,540,733 A * 11/1970 Lamattina ..... 473/153
3,558,139 A * 1/1971 Brandell et al. ..... 473/162
3,700,243 A 10/1972 Kenney
3,817,535 A * 6/1974 Doughty ..... 473/185
3,990,573 A * 11/1976 Cross ..... 190/115
4,017,084 A * 4/1977 Jeffery ..... 473/162
4,596,391 A * 6/1986 Carolan, Jr. ..... 473/158
5,171,016 A * 12/1992 Kamal ..... 473/160
7,255,648 B1 * 8/2007 Romeo ..... 473/180
7,258,621 B2 * 8/2007 McDuffee ..... 473/162
7,294,062 B2 * 11/2007 Ting ..... 473/162
7,473,183 B2 * 1/2009 McDuffee ..... 473/162
7,556,566 B2 * 7/2009 Shin ..... 473/162
8,235,880 B2 8/2012 Guier
2003/0073506 A1 * 4/2003 Coplien ..... 473/157
2003/0096658 A1 * 5/2003 Elliott ..... 473/162
2005/0209014 A1 * 9/2005 Kim ..... 473/157

* cited by examiner

*Primary Examiner* — Mark Graham
(74) *Attorney, Agent, or Firm* — William Nitkin

(57) ABSTRACT

A golf putting practice device having a box structure with a lid that when open is offset from and disposed at a lower height than the top of said box, the lid forming a ramp, such device including a mat extending from a cup area within the box, down the ramp and extending beyond for putting a golf ball along the mat to the cup, such mat being foldable within the box for storage when the top lid is closed.

5 Claims, 10 Drawing Sheets

12
26
102
34
104
14
16
28

12
28
27
16
32
30
18

12
24
16
118
32
38
36

GOLF PUTTING BOX

BACKGROUND OF THE INVENTION

1. Field of the Invention

This invention resides in the field of golf putting practice devices and more particularly relates to a box that opens and has a mat therein that extends outside the box along which a golf ball can be putted into a portion of the box containing an aperture acting as a cup for receipt of the golf ball.

2. History of the Prior Art

Golf putting practice devices are well known in the prior art. They usually consist of a mat on which a golf ball is putted which leads to a structure having a cup for receipt of the golf ball. Currently the Applicant is aware of the following prior art that relates to box-type structures for practicing golf putting, the first being U.S. Pat. No. 3,700,243 to Kenney entitled Putting Cup Arrangement for Golf Practice. In the device of this patent a box that is shaped like a book has an openable lid which extends downward from the side of the box toward the ground surface on which the box is placed and an inset portion having an aperture formed therein for receipt of the golf ball when putted up the inner surface of the lid which is disposed at an angle to the book-like structure. The problem with this device is that since the angle of the lid is determined by the height of the side of the book-like structure, the golf ball must go up a steep incline or ramp before it gets to the surface where the hole forming the cup is located. This steep incline means the ball must be hit hard to get it up the ramp. A similar arrangement is found in U.S. Pat. No. 8,235,880 to Guier entitled Apparatus and Method of Packaging Golf Balls where the golf ball box lid comes off the box and has an aperture formed therein acting as a cup. Such lid is disposed at an angle to the box with a portion of the lid resting on the ground surface. One must then putt up the steep incline of the box lid to get the ball into the aperture where it then falls into the box. Again the steepness of the incline of the lid creates an unnatural situation where one must putt much harder than one normally would to have the golf ball travel up the incline to fall into the aperture.

SUMMARY OF THE INVENTION

The device of this invention consists of a box with a lid that opens and which has an aperture acting as a cup being a hole defined within an inner surface in the inside of the box along with a 4-foot long fabric-like flexible mat which extends down the inner side of the open box lid along the floor surface on which the box is placed so that one can putt a golf ball toward and into the aperture. The formation of the side of the box on which the lid is attached is such that a portion of the lid referred to as a box extension is not attached to the adjacent first and second box sides so that it folds downward on a scored line, extending the lid away from the box and causing the lid to be hinged away from the box at a lower height than the height of the other box sides of the box, thereby decreasing the angle of the incline of the lid on which the golf ball is putted. Thus, when the golf ball is putted along the mat and up the lid forming a ramp to reach the golf ball receipt aperture, it does not have to be artificially struck with a greater force than what might normally be required at a golf course, making the use of the golf putting box of this invention more realistic in nature than the box-like golf putting practice devices of the prior art.

DESCRIPTION OF THE PREFERRED EMBODIMENT(S)

Figure 1:
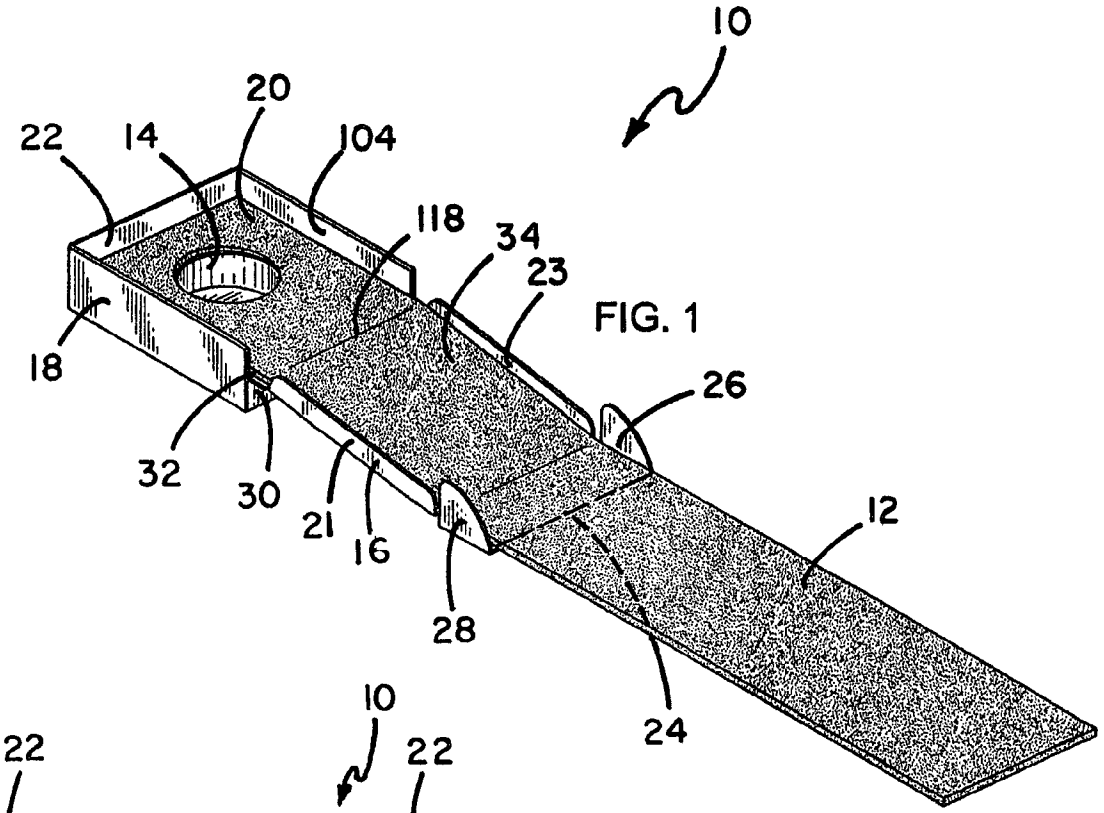
FIG. 1 illustrates a perspective view of the golf putting box of this invention in its open mode with the mat extended.
Figures 4, 5, 6:
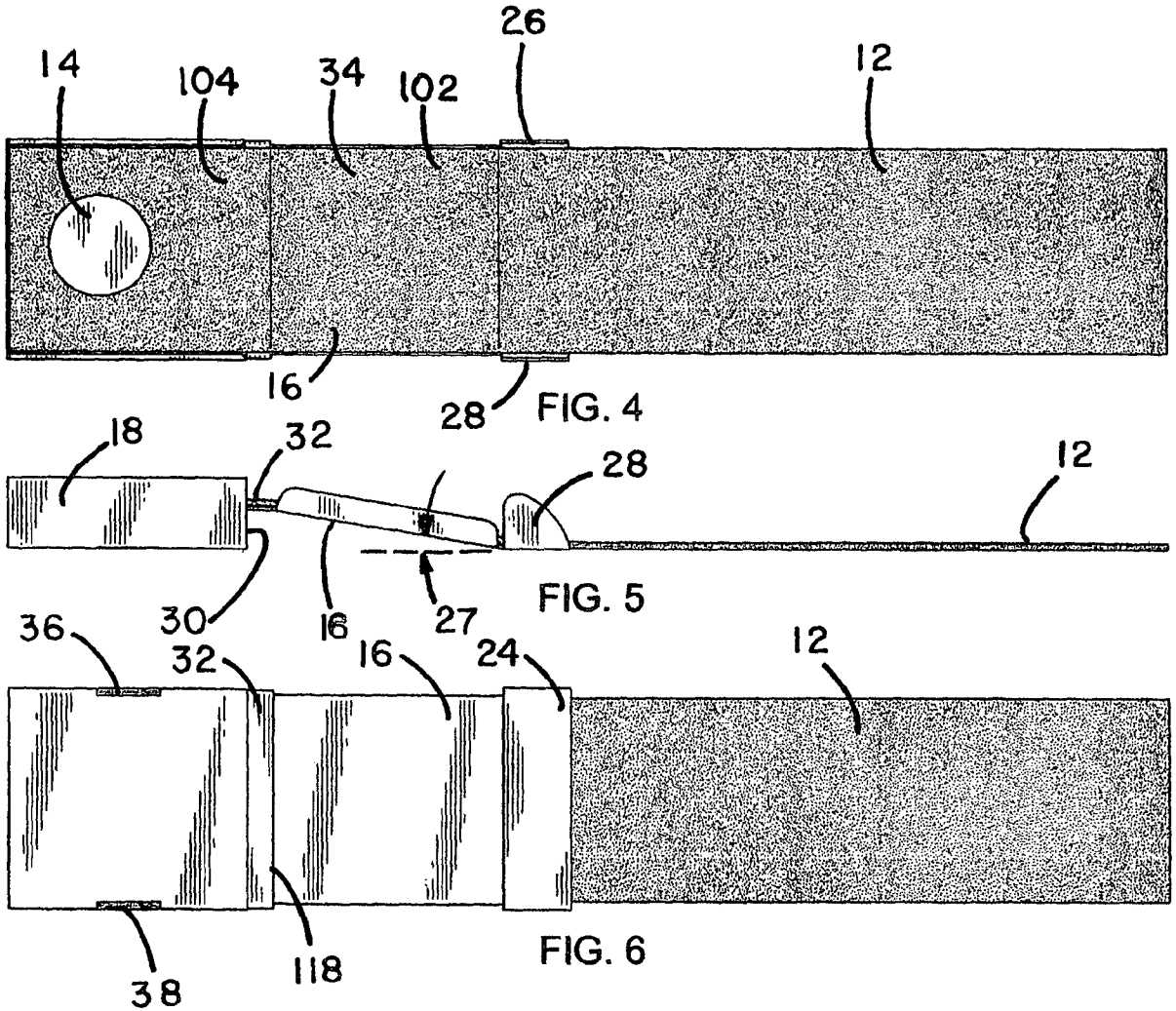
FIG. 4 illustrates a top plan view of the golf putting box of this invention in its open mode with the mat extended.
FIG. 5 illustrates a left side elevational view of the golf putting box of FIG. 4.
FIG. 6 illustrates a bottom plan view of the golf putting box of FIG. 4.
Figure 7:
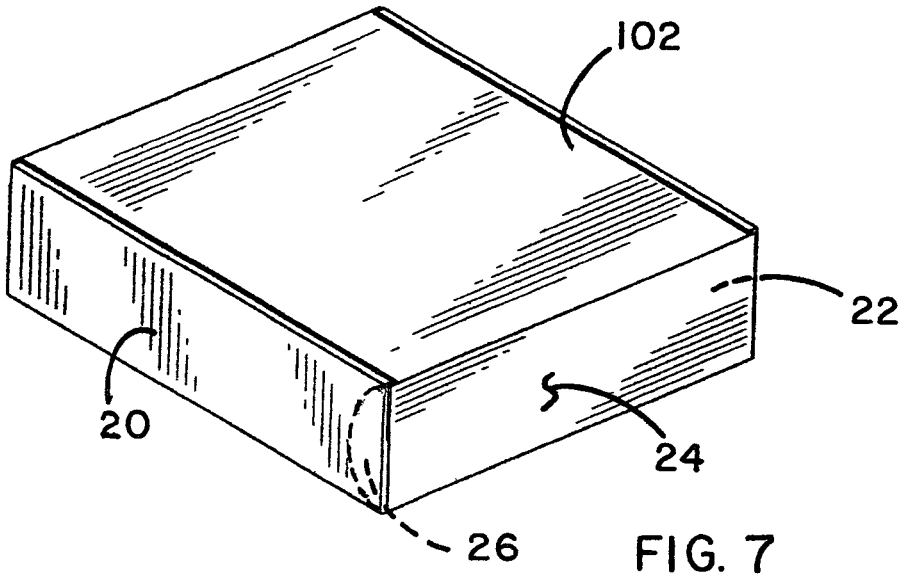
FIG. 7 illustrates a perspective view of the golf putting box of this invention in its closed mode.
Figure 8:
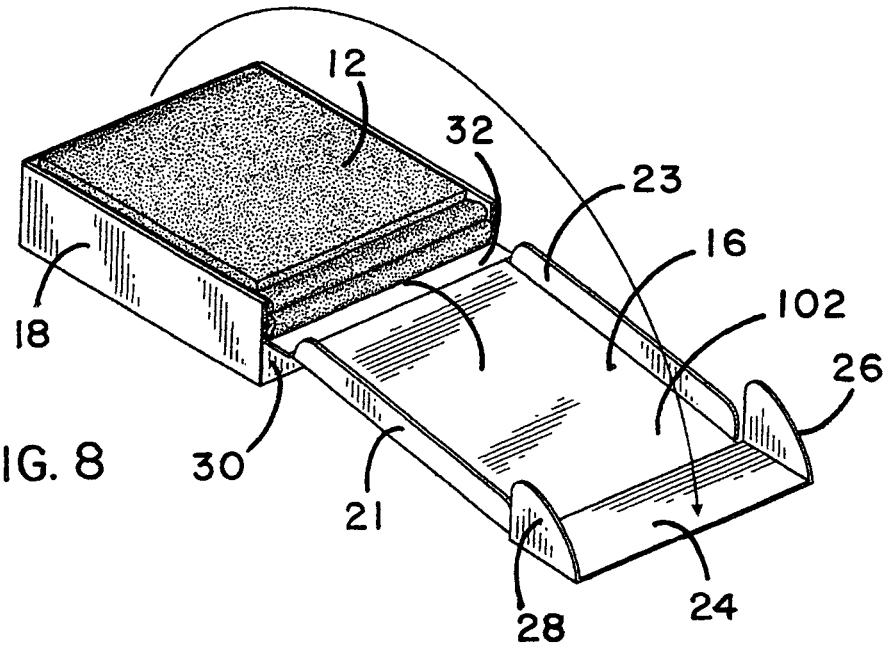
FIG. 8 illustrates a perspective view of the golf putting box of this invention with the lid opened and showing the mat still folded within the box.
Figure 9:
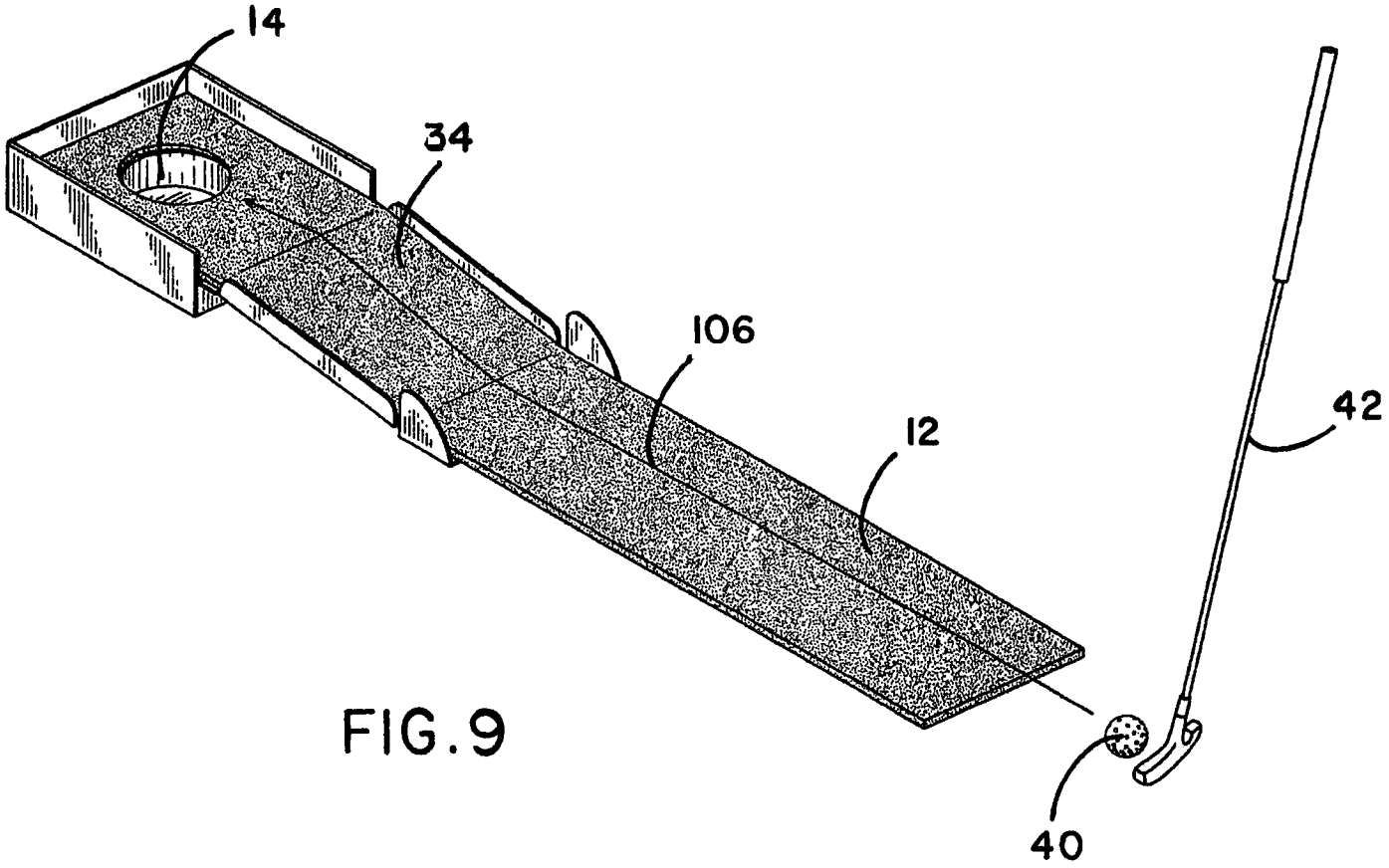
FIG. 9 illustrates a perspective view of the golf putting box of this invention with the mat extended showing a golf ball and putter with the ball aligned to be hit along a directional line toward the hole.

FIG. 1 illustrates box 10 of the golf putting practice device of this invention in its open mode with mat 12 fully extended down ramp 16 formed from box top lid 102 so that a golf ball 40, as shown in FIG. 9, can be putted along mat 12, up ramp 16 and into hole 14. Offsetting top end 118 of ramp 16 that attaches to box 10 is box extension 32 which is not attached to the first and second box sides 18 and 20 but folds down on scored fold line 120 shown in FIG. 8 from fourth box side 30 seen in FIG. 5 which fourth box side 30 extends only part way up the side of the box, as seen in FIG. 1. The height of fourth box side 30 is lower than the height of the other box sides. These features allow top end 118 of ramp 16, as seen in FIG. 6, to be disposed at lower angle of incline, as denoted by angle of incline 27 seen in FIG. 5 than if it extended from the actual height of the other box sides, such as first box side 18 and second box side 20. This lower height makes putting easier and more natural since one does not have to hit the golf ball with an unnaturally harder stroke to reach the short distance that hole 14 is away from the player. Also seen in FIG. 1 are first and second ramp sides 21 and 23 of ramp 16 which fold into the box and first and second tabs 28 and 26 which, when top lid 102 is in its closed position on the box, insert into slots formed in first box side 18 and second box side 20 where they attach to third box side 22. When first box side 18 and second box side 20 have their ends folded over with the first box side tab 112 and second box side tab 114 inserted into first box receipt slot 36 and second box receipt slot 38, enclosing first, second, third and fourth side inserts 44, 46, 48, and 50, shown in FIG. 10, a space is formed which, when top lid 102 is closed and first and second ramp sides 21 and 23 are positioned on the inside of first box side 18 and second box side 20, then first tab 26 and second tab 28 at the ends of end enclosure flap 24 can be inserted into the space formed between third box side 22 and first box side 18 and into the space formed between second box side 20 and third box side 22, as seen in FIG. 7.

Figure 2:
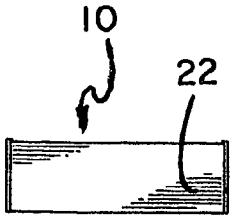
FIG. 2 illustrates an end elevational view of the golf putting box of this invention in its closed mode.
Figure 3:
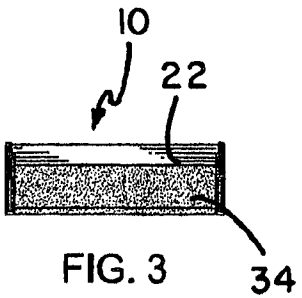
FIG. 3 illustrates a front elevational view of the golf putting box of FIG. 1 showing the mat extended with a view of the inside of the third box side.

FIG. 2 illustrates an end elevational view of box 10, showing third box side 22. FIG. 3 illustrates a front end elevational view of box 10 showing the mat 12 extending along ramp 16 at an angle so that the mat on the ramp designated by reference number 34 extends all the way over cup surrounding surface 104 to third box side 22 at the rear of the box. FIG. 4 illustrates a top plan view showing mat 12 extending between first and second tabs 28 and 26, up ramp 16 being designated as the mat on ramp 34 and surrounding cup 14 which is formed in insert member 108, as will be described further below.

FIG. 5 illustrates a left side elevational view of the box seen in FIG. 4 showing mat 12 extending by first tab 28 up ramp 16 and over box extension 32, as best seen in FIG. 6 which is a bottom view of the box of FIG. 4, where box extension 32 extends outward from fourth box side 30 which disposes it at a lower angle of incline, designated as angle of incline 27, from a steeper angle of incline from the height from the top edges of the other box sides.

FIG. 8 illustrates a perspective view showing top lid 102 of box 10 being opened where it now forms ramp 16 which is attached to the box by box extension 32 attached along its length to scored fold line 120 to fourth box side 30. Also seen is first box side 18 along with the other box sides holding mat 12 which is folded in place therein and which in use is manually lifted and pulled outward because a portion of it is adhered to cup surrounding surface 104, as seen in FIG. 1, as will be described further below, around cup 14 with such mat 12 extended down ramp 16 and outward as seen in FIG. 9 for the golf ball 40 to be putted by putter 42 along ball direction line 106 to fall into cup 14.

Figure 10:
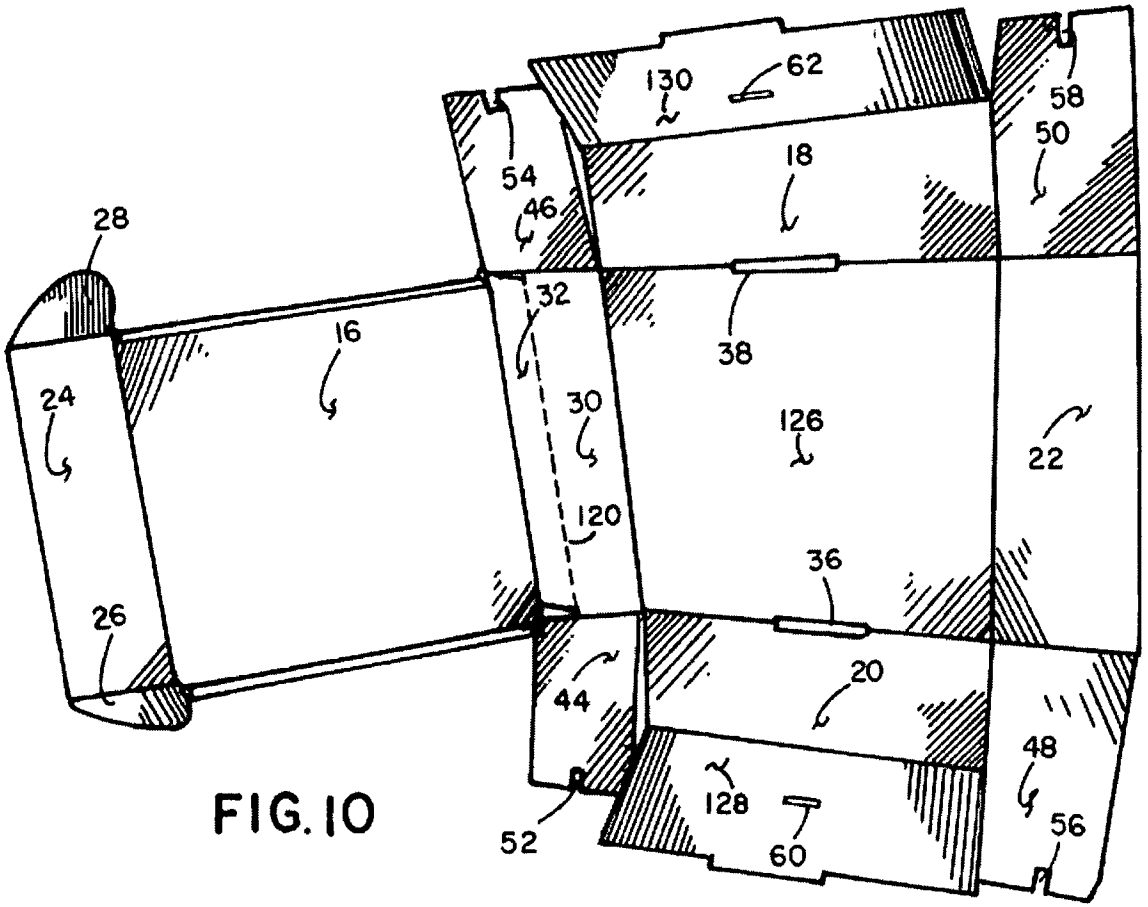
FIG. 10 illustrates a perspective view of the interior of the golf putting box in an open form.
Figure 11:
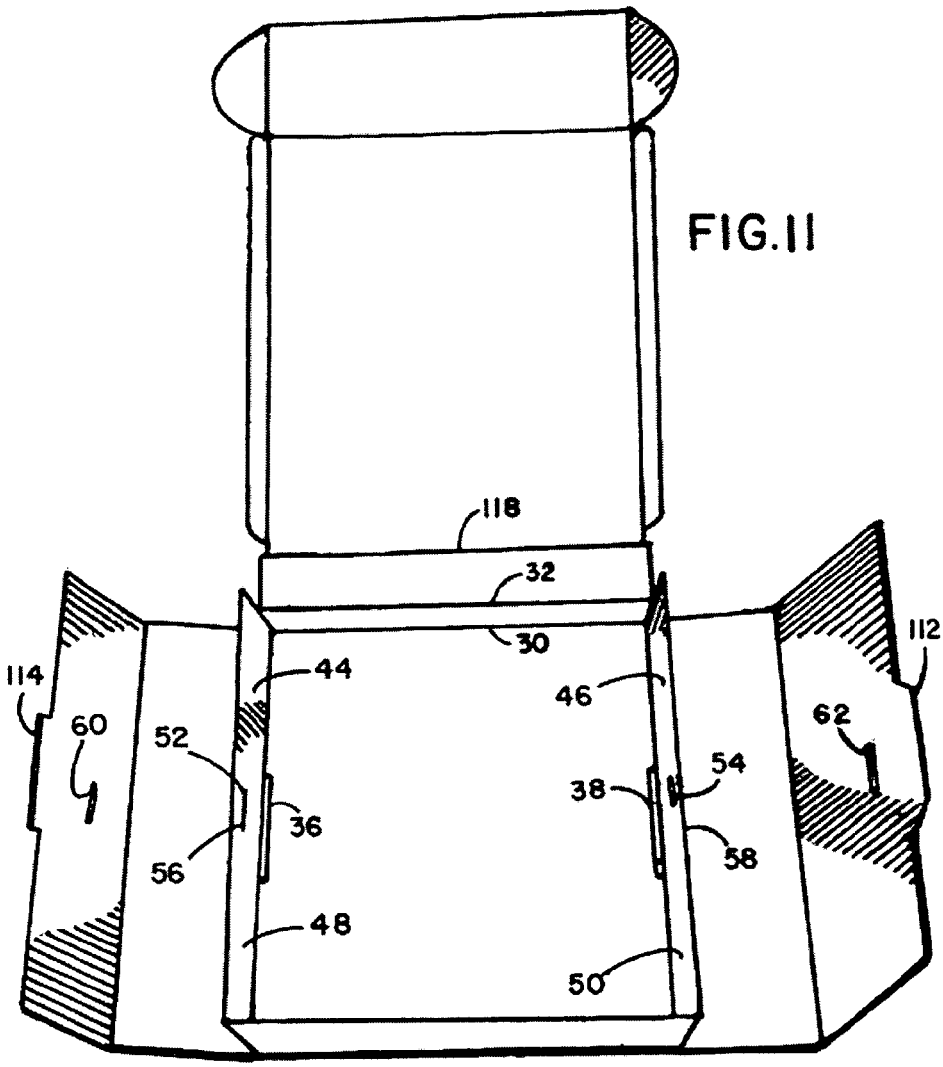
FIG. 11 illustrates a perspective view of the golf putting box shown at a different angle to that of FIG. 10 with elements of the box folded into position, starting to form the sides.
Figure 12:
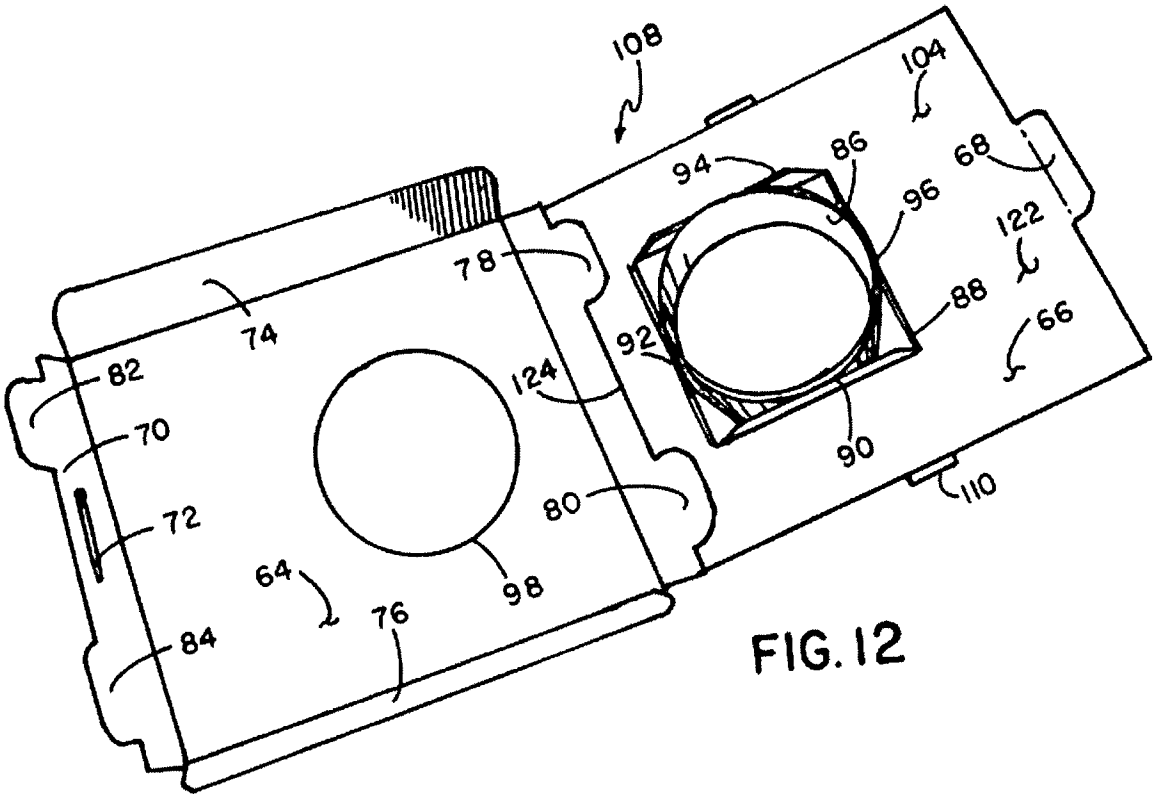
FIG. 12 illustrates an perspective open view of the box insert which contains the hole.
Figure 13:
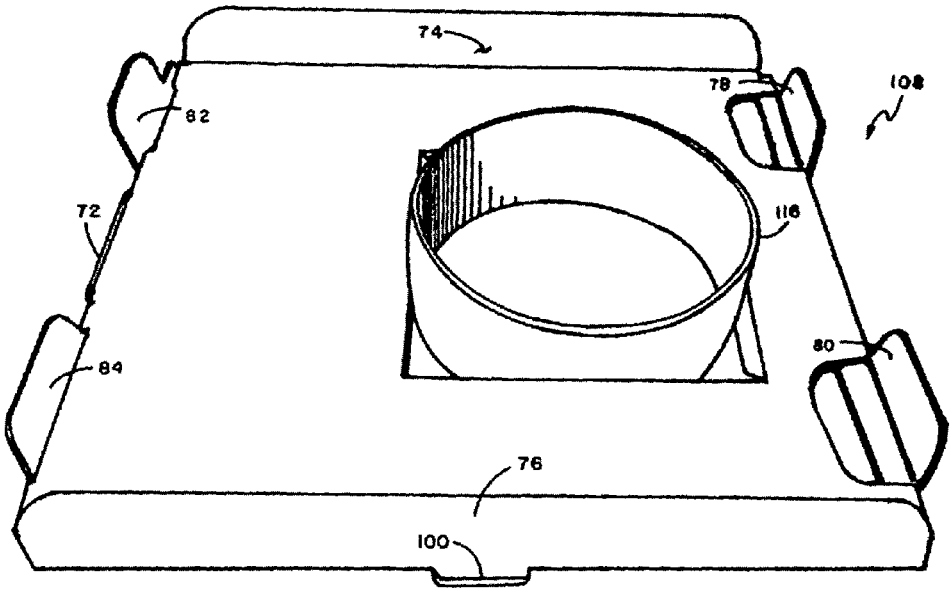
FIG. 13 illustrates a perspective view of golf putting box insert after being folded and formed.
Figure 14:
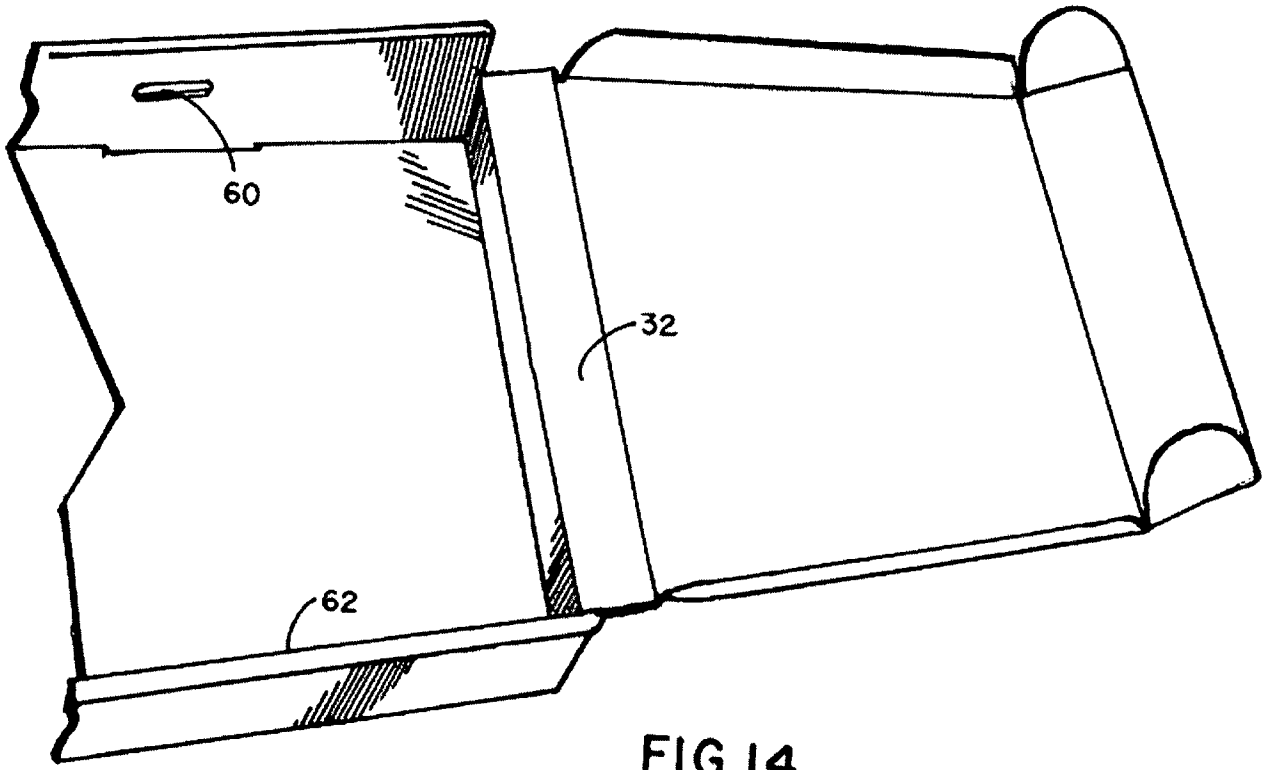
FIG. 14 illustrates a partial perspective view of a portion of the golf putting box itself assembled ready to receive the box insert.
Figure 15:
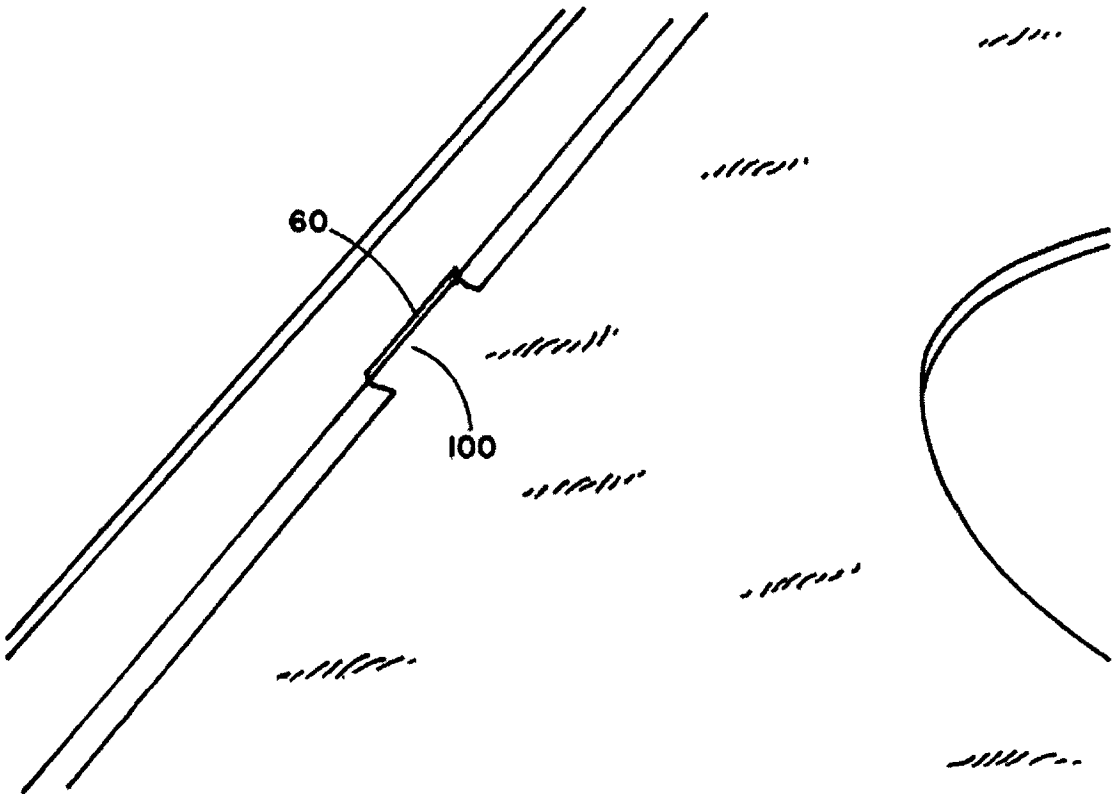
FIG. 15 illustrates a partial perspective view of the box insert with mat thereon showing the second box side and the first box tab inserted into the first top insert slot.

FIG. 10 shows the interior of box 10 in its open mode where it is seen that first, second and third sides 18, 20 and 22 are formed by multiple connected elements. To assemble box 10, one first lifts up the fourth box side 30 which is attached to first side insert 44 and second side insert 46 and also lifts up third box side 22 which is attached to fourth side insert 50 and third side insert 48. Each side insert has defined at its end a slot; and those slots, as seen in FIG. 11, when the sides are up and all the side inserts are bent inward being perpendicular to bottom member 126, come together and have first and second extension insert slots 60 and 62 defined therein for retention of insert member 108, as described below. At this point in the assembly first box side 18 with its second extension member 130 and second box side 20 with its first extension member 128 have their extension members folded up and over first, second, third and fourth side inserts 44, 46, 48, and 50. Within the first and second extension members 128 and 130 are first and second extension insert slots 60 and 62 that align with first, second, third and fourth side insert slots 52, 54, 56 and 58. FIG. 14 shows extension insert slots 60 and 62, and FIG. 15 shows first insert tab 100 inserted into first extension insert slot 60. In this way the sides of the box are formed along with box extension 32 which is not attached to the first and second side inserts 44 and 46. Within the box is positioned insert member 108, such as seen in FIGS. 12 and 13, which has first side 74 and second side 76 forming leg members and has a slot 72 formed in foldable portion 70 also forming a leg member such that when cylinder retention member 66 is bent on insert fold line 124 which cylinder retention member 66 contains cylinder 86 which forms the hole 14. First leg member 78 and second leg member 80 are formed as cylinder retention member 66 is bent forward for tab 68 to enter into slot 72 which, as seen in FIG. 13, allows for first leg, second leg, third leg and fourth leg members 78, 80, 82 and 84 to be formed which will extend downward in the box to support cup surrounding surface member 104 of insert member 108 at the height of fourth box side 30 along with first side 74 and second side 76 of insert member 108 which also form support members such that first box tab 100, as seen in FIG. 15, and the second box tab not shown will insert when insert member 108 is inverted and placed into box 10 into first extension insert slot 60, as seen in FIG. 14, and second extension insert slot 62, respectively, to hold insert member 108 in place within the box. Mat 12 is adhered by adhesive on top of cup surrounding surface 104 so that the rest of mat 12 can be folded for storage, as seen in FIG. 8.

The golf putting box of this invention can be manufactured and sold as a promotional item or as a premium with advertising and labeled as desired by the manufacturer.

Although the present invention has been described with reference to particular embodiments, it will be apparent to those skilled in the art that variations and modifications can be substituted therefor without departing from the principles and spirit of the invention.

I claim:

1. A golf putting practice device for use with a golf ball and a putter, said device for positioning on a surface, comprising:

a box including:

first, second and third sides being of equal height, each of said sides having first and second ends, and having a top edge and a bottom edge, said first end of said first side adjoined to said first end of said third side, said first end of said second side adjoined to said second end of said third side, said first and second sides being parallel and spaced apart a distance from one another, said second ends said first and second sides each having a lower portion thereof;

a fourth side having first and second ends, a top edge having a length, a bottom edge and a height that is lower than the height of said first, second and third sides, said fourth side adjoined to said lower portions of said second ends of said first and second sides;

a bottom member extending and attached to said bottom edges of said first, second, third and fourth sides, said bottom member disposed perpendicular to said first, second, third and fourth sides;

a box extension member having first and second sides and a height, said first side foldably attached along a fold line to said top edge of said fourth box side, said box extension member extending along said length of said top edge of said fourth side and being foldable away from said second ends of said first and second sides at said height of said fourth side;

a top lid having a rectangular configuration and first, second, third and fourth lid sides, said first lid side being hingeably attached to said second side of said box extension member, said box in a first closed mode being positioned with said box extension member being folded upward against said second ends of said first and second sides and said top lid resting on said top edges of said first, second and third sides to close said box, and in a second open mode said top lid being opened by movement on said hinged first lid side to said box extension member at the same time as said box extension member is folded away at said first side of said box extension member on said fold line with said fourth side of said box to extend said top lid away from said box a distance equal to said height of said box extension member extending away from said second ends of said first and second sides at the height of said top edge of said fourth side of said box, said top lid forming a ramp when its third side is resting on said surface;

a cup having a diameter disposed in said box;

a cup surrounding surface member having a central portion defined between said first, second, third and fourth sides of said box, said cup surrounding surface member disposed at the height of said fourth side, said cup positioned in said central portion, and a flexible mat having an aperture defined therein, said aperture having approximately the same diameter as the diameter of said cup, said mat being in the shape of an elongated rectangle, said mat having a width approximately the distance between said first and second sides, said mat being adhered to said cup surrounding surface member such that said aperture is disposed above said cup and said width of said mat is disposed between said first and second sides of said box, said mat being foldable in said box in said first closed mode above said cup surrounding surface member and contained by said top lid when in its closed position and when said box is in its second open mode with it top lid open said mat extending down said ramp formed by said third side of said top lid resting on said surface and extending along said surface, said mat in its second open mode having said golf ball travel thereon, when struck by said putter, up said ramp to fall into said cup.

2. The device of claim 1 further including:

first and second extension members foldably attached, respectively, to said bottom edges of said first and second sides;

first and second insert members foldably attached, respectively, to said first and second ends of said third side;

third and fourth insert members foldably attached, respectively, to said first and second ends of said fourth side; and wherein when said third and fourth sides are positioned upright perpendicular to said bottom member, said first, second, third and fourth insert members can be rotated along said junction of said bottom edges of said third and fourth sides to said bottom member and said first and second extension members of said first and second sides can be folded downward, respectively, over said first, second, third and fourth insert members, said first and second extension members then positioned adjacent to said first and second sides and enclosing said first, second, third and fourth insert members.

3. The device of claim 2 further including:

first and second tab members formed, respectively, on said first and second extension members of said first and second sides; and first and second receipt slots defined in the junctions between said bottom member and said bottom edges of said first and second sides for receipt of said first and second tab members when first and second extension members of said first and second sides are folded over said first, second, third and fourth insert members to retain said first and second side extension members in place when said box is assembled.

4. The device of claim 3 further comprising:

an insert member including:

said cup surrounding surface member having an aperture defined therein, said cup surrounding surface member having a top, a bottom and edges;

a cylinder defining said cup retained within said aperture in said cup surrounding surface member extending from said bottom of said cup surrounding surface member; and a plurality of leg members disposed at said edges of said cup surrounding surface member, said plurality of leg members having a height approximately equal to the height of said fourth side of said box for supporting said cup surrounding surface member at said height of said fourth side of said box;

first and second side tabs extending from opposite sides of said cup surrounding surface member; and first and second extension insert slots defined, respectively, in said first and second extension members for receipt of said first and second tab members, respectively, for retaining said insert member and said mat that is adhered thereto in said box.

5. The device of claim 4 further including first, second, third and fourth side insert slots defined, respectively, in said first, second, third and fourth insert members, said first and second extension insert slots and said first, second, third and fourth side insert slots for receipt of said first and second side tabs, said side insert slots aligned with said first and second extension insert slots for retaining said insert member and said mat that is adhered thereto in said box.

* * * * *